US008535068B2

(12) United States Patent
Tsai et al.

(10) Patent No.: US 8,535,068 B2
(45) Date of Patent: Sep. 17, 2013

(54) USB CONNECTOR

(75) Inventors: Chia-Hsin Tsai, New Taipei (TW); Charles C. Lee, New Taipei (TW)

(73) Assignee: Power Quotient International Co., Ltd., New Taipei (TW)

( * ) Notice: Subject to any disclaimer, the term of this patent is extended or adjusted under 35 U.S.C. 154(b) by 41 days.

(21) Appl. No.: 13/425,503

(22) Filed: Mar. 21, 2012

(65) Prior Publication Data

US 2013/0143421 A1 Jun. 6, 2013

(30) Foreign Application Priority Data

Dec. 2, 2011 (TW) ..... 100222804 U

(51) Int. Cl.
*H01R 12/00* (2006.01)

(52) U.S. Cl.
USPC ..... 439/83

(58) Field of Classification Search
USPC ..... 439/83, 862, 630, 660, 607.4, 607.01, 439/79
See application file for complete search history.

(56) References Cited

U.S. PATENT DOCUMENTS

| | | | | |
|---|---|---|---|---|
| 7,850,465 | B1 * | 12/2010 | Wan et al. | 439/79 |
| 8,070,526 | B2 * | 12/2011 | Zhu | 439/660 |
| 8,079,876 | B2 * | 12/2011 | Wang et al. | 439/630 |
| 8,087,942 | B2 * | 1/2012 | Chen | 439/74 |
| 8,376,785 | B2 * | 2/2013 | Lapidot et al. | 439/660 |
| 2009/0042421 | A1 * | 2/2009 | Zheng et al. | 439/83 |
| 2011/0104914 | A1 * | 5/2011 | Zhu | 439/83 |
| 2012/0003852 | A1 * | 1/2012 | Chang | 439/83 |

* cited by examiner

*Primary Examiner* — Jean F Duverne
(74) *Attorney, Agent, or Firm* — Guice Patents PLLC

(57) ABSTRACT

The present invention relates to a USB connector, which comprises: a connector main body having its front being downwardly extended thereby forming a stop part having a first lead angle; and a substrate having plural first contact pads and plural second contact pads, so as to form a USB connector. Said USB connector allows a USB2.0 connector and a USB3.0 connector to be respectively inserted.

20 Claims, 10 Drawing Sheets

USB CONNECTOR

BACKGROUND OF THE INVENTION

1. Field of the Invention

The present invention relates to a USB connector, especially to a USB connector supporting both protocols of USB2.0 and USB3.0.

2. Description of Related Art

A peripheral device having USB interfaces provides a plug-and-play function, so after relevant products are launched, the products really catch consumers attention. The USB2.0 protocol is capable of providing a transmission speed up to 480M bits/sec. With the development of multimedia technology, if a multimedia file having a volume of 25 GB is desired to be downloaded through the USB2.0 protocol, it may take quite a while and may not satisfy consumer's needs. As a result, the USB3.0 protocol is launched, the USB3.0 protocol is capable of providing a transmission speed up to 4.8 G bits/sec, if the same 25 GB multimedia file is desired to be downloaded through the USB 3.0 protocol, the required time is only one tenth of the original time that the USB2.0 protocol may take.

However, the USB2.0 protocol is still the main stream in the market, and most peripheral devices having USB interfaces can only support the USB2.0 protocol, so how to design an electric connector capable of supporting both of the USB2.0 and USB3.0 protocols is an issue to be concerned.

Referring to FIG. 1*a* and FIG. 1*b*, wherein FIG. 1*a* is a schematic view illustrating the front of a substrate of a conventional USB connector not being formed with a lead angle structure and FIG. 1*b* is a schematic view illustrating the substrate of a conventional USB connector being inserted with the terminal of a USB plug. As shown in FIG. 1*a*, the terminal 10 of a conventional USB connector is abutted against the front edge of a substrate 20, so there is no space for forming a lead angle at the front edge of the substrate 20 for guiding the terminal 10 to be smoothly inserted in a USB plug 30; as shown in FIG. 1*b*, when the terminal 10 is inserted in the USB plug 30, the front edge of a terminal 31 of the USB plug 30 is very likely to be picked and backwardly squeezed then deformed due to the front edge of the substrate 20 not being formed with a lead angle, said condition may cause imperfect contact relative to the USB plug 30.

With respect to the mentioned disadvantages of conventional connectors, the present invention provides a novel USB connector for improving said disadvantages.

SUMMARY OF THE INVENTION

One primary objective of the present invention is to provide a USB connector in which the front of a substrate is formed with a lead angle, so when being inserted with a USB plug, the lead angle allows the front edge of the substrate to be in forward contact with terminals of the USB plug without squeezing the front edges of the terminals of the USB plug.

Another objective of the present invention is to provide a USB connector in which plural first contact pads and plural second contact pads are installed, and the plural first contact pads and the plural second contact pads can staggeringly arranged at the same side or oppositely arranged.

One another objective of the present invention is to provide a USB connector having a USB2.0 connector and a USB3.0 connector having different transmission speed, for meeting the needs of transmitting with different transmission speeds.

Still one another objective of the present invention is to provide a USB connector having advantages of thinner thickness, lower production cost and not limiting to be applied in certain models when being used.

For achieving said objectives, the present invention provides a USB connector, which comprises: a connector main body having plural open slots, plural first terminals and plural second terminals, every two open slots are spaced by a slot column, wherein one end of the plural first terminals are respectively disposed in front of the plural slot columns, the lateral sides thereof are respectively and downwardly bent then further bent towards right or left thereby forming a first solder end, one end of the plural second terminals are respectively provided in the plural open slots and exposed outside the open slots, the other ends are respectively and downwardly bent then horizontally extended thereby forming a second solder end, the front of the connector main body is downwardly extended thereby forming a stop part having a first lead angle; and a substrate having plural first contact pads and plural second contact pads, wherein the plural first contact pads are disposed at the front portion of the substrate and at the locations corresponding to the first solder ends thereby allowing the plural first terminals to be coupled with, the plural second contact pads are disposed at the rear portion of the substrate and at the locations corresponding to the second solder ends thereby allowing the plural second terminals to be coupled with, so as to form a USB connector.

For achieving said objectives, the present invention provides a USB connector, which comprises: a connector main body having plural open slots, plural first terminals and plural second terminals, wherein every two open slots are spaced by a slot column, one end of the plural first terminals are respectively disposed below the plural slot columns and exposed outside the plural slot columns then forwardly extended, the other ends are respectively and downwardly bent then horizontally extended thereby forming a first solder end, one end of the plural second terminals are respectively provided in the plural open slots and exposed outside the open slots, the other ends are respectively and downwardly bent then horizontally extended thereby forming a second solder end, the front of the connector main body is downwardly extended thereby forming a stop part having a first lead angle; and a substrate having plural first contact pads and plural second contact pads, and the plural first contact pads and the plural second contact pads are staggeringly arranged for being respectively coupled to the plural first terminals and the plural second terminals, thereby forming a USB connector.

For achieving said objectives, the present invention provides a USB connector, which comprises: a connector main body having plural open slots, plural first terminals and plural second terminals, every two open slots are spaced by a slot column, wherein one end of the plural first terminals are respectively disposed in front of the plural slot columns, the lateral sides thereof are respectively and downwardly bent then further bent towards right or left thereby forming a first solder end, one end of the plural second terminals are respectively provided in the plural open slots and exposed outside the open slots, the other ends are respectively and downwardly bent then horizontally extended, thereby forming a second solder end, the front of the connector main body is formed with a first lead angle; and a substrate having plural first contact pads and plural second contact pads, wherein the plural first contact pads are disposed at the front portion of the substrate and at the locations corresponding to the first solder ends thereby allowing the plural first terminals to be coupled with, the plural second contact pads are disposed at the rear portion of the substrate and at the locations corresponding to the second solder ends thereby allowing the plural second terminals to be coupled with, so as to form a USB connector.

For achieving said objectives, the present invention provides a USB connector, which comprises: a connector main body having plural open slots, plural first terminals and plural second terminals, wherein every two open slots are spaced by a slot column, one end of the plural first terminals are respectively disposed below the plural slot columns and exposed outside the plural slot columns then forwardly extended, the other ends are respectively and downwardly bent then horizontally extended thereby forming a first solder end, one end of the plural second terminals are respectively provided in the plural open slots and exposed outside the open slots, the other ends are respectively and downwardly bent then horizontally extended thereby forming a second solder end, the front of the connector main body is formed with a first lead angle; and a substrate having plural first contact pads and plural second contact pads, and the plural first contact pads and the plural second contact pads are staggeringly arranged for being respectively coupled to the plural first terminals and the plural second terminals, thereby forming a USB connector.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
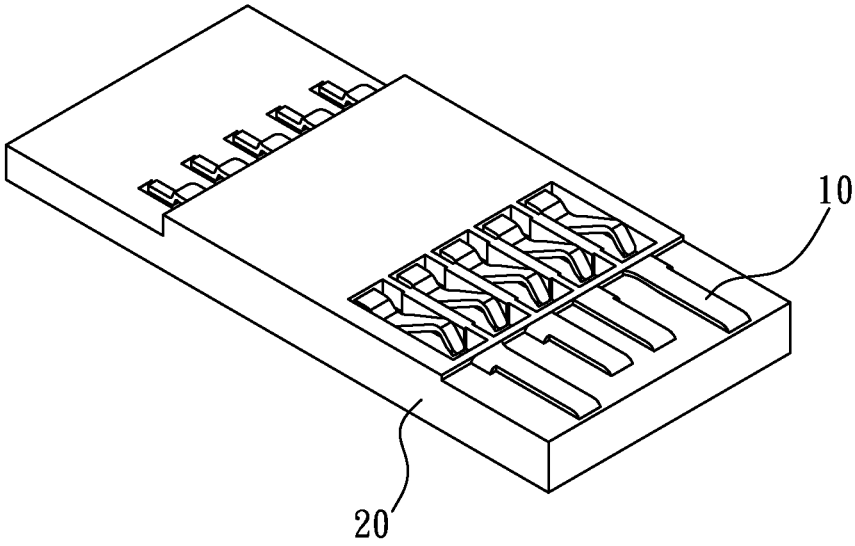
(PRIOR ART) FIG. 1a
FIG. 1*a* is a schematic view illustrating the front of a substrate of a conventional USB connector not being formed with a lead angle structure.
Figure 1B:
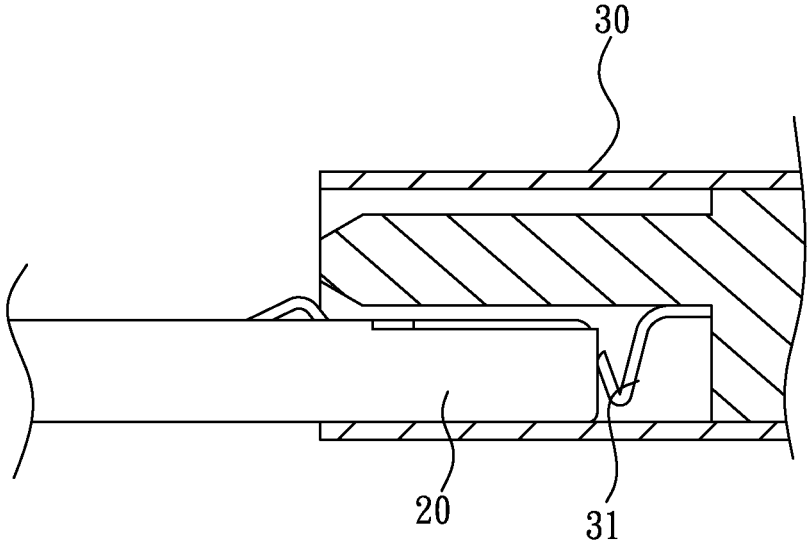
(PRIOR ART) FIG. 1b
FIG. 1*b* is a schematic view illustrating the substrate of a conventional USB connector being inserted with the terminal of a USB plug.
Figure 2:
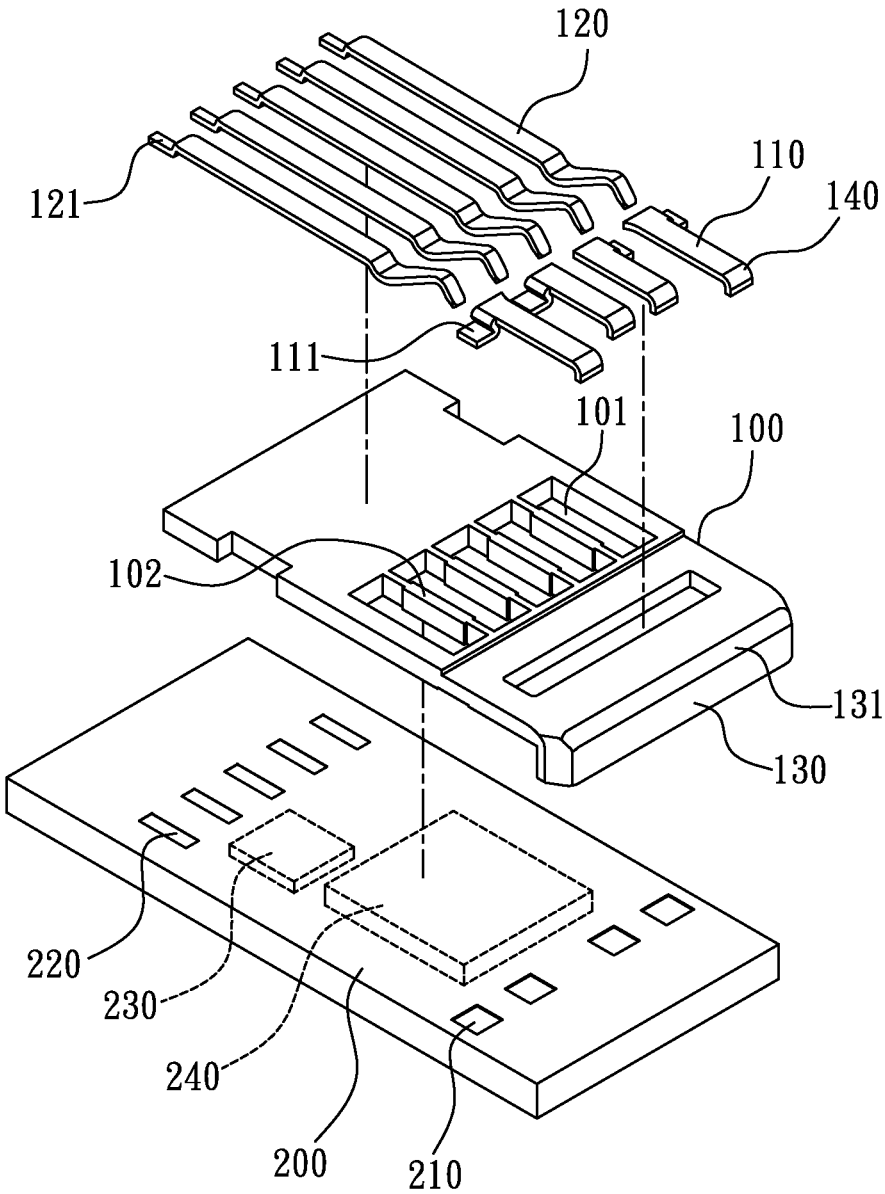
FIG. 2 is a schematic exploded view showing the USB connector according to one preferred embodiment of the present invention.
Figure 3:
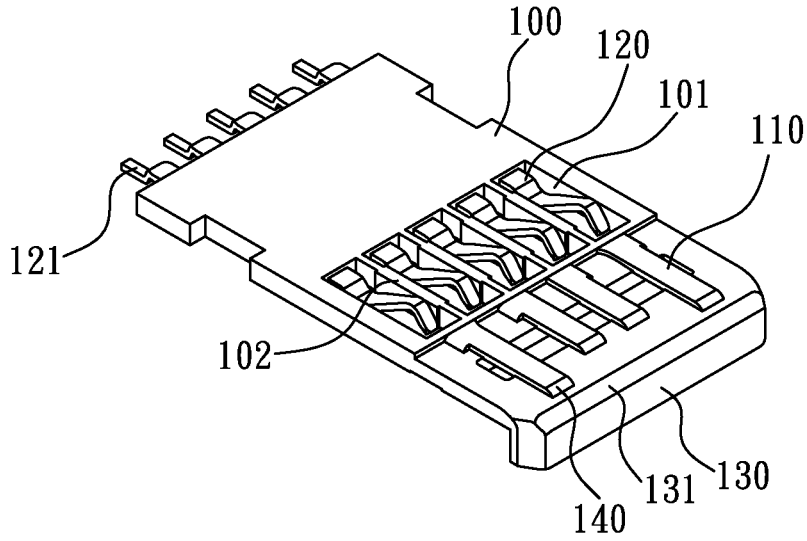
FIG. 3 is a schematic view showing the assembly of the connector main body according to one preferred embodiment of the present invention.
Figure 4:
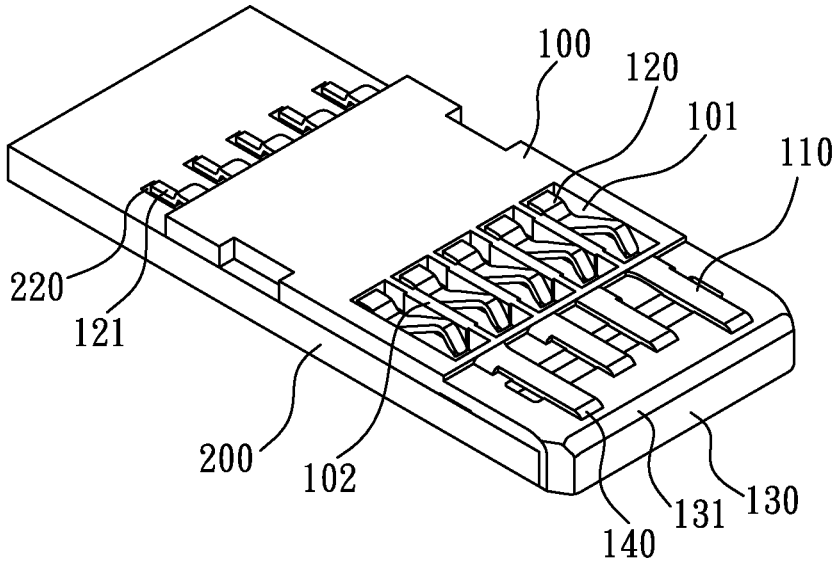
FIG. 4 is a schematic view showing the assembly of the USB connector according to one preferred embodiment of the present invention.
Figure 5:
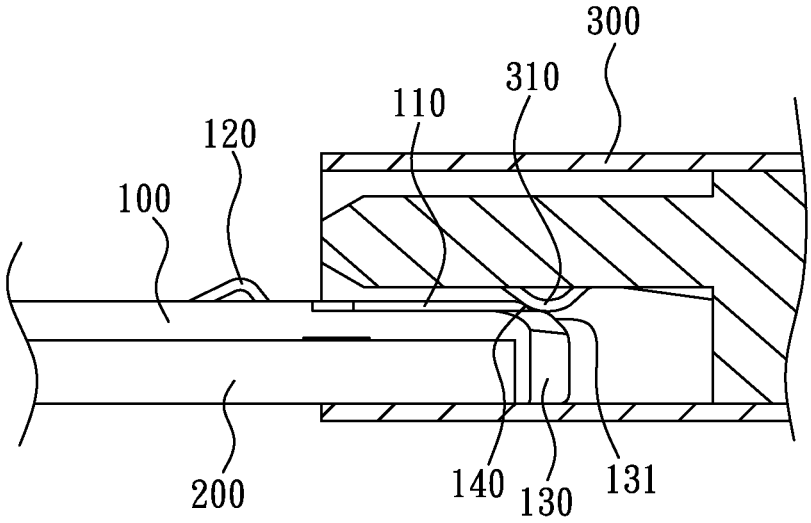
FIG. 5 is a schematic view illustrating the substrate of the USB connector being inserted with the terminal of a USB plug according to one preferred embodiment of the present invention.

The accompanying drawings are included to provide a further understanding of the invention, and are incorporated in and constitute a part of this specification. The drawings illustrate embodiments of the invention and, together with the description, serve to explain the principles of the invention, wherein FIG. 2 is a schematic exploded view showing the USB connector according to one preferred embodiment of the present invention; FIG. 3 is a schematic view showing the assembly of the connector main body according to one preferred embodiment of the present invention; FIG. 4 is a schematic view showing the assembly of the USB connector according to one preferred embodiment of the present invention; and FIG. 5 is a schematic view illustrating the substrate of the USB connector being inserted with the terminal of a USB plug according to one preferred embodiment of the present invention.

As shown in figures, the USB connector provided by the present invention comprises a connector main body 100 and a substrate 200.

The connector main body 100 is made of an insulation material, e.g. but not limited to plastic, and is formed with plural open slots 101, plural first terminals 110 and plural second terminals 120, wherein every two open slots 101 are spaced by a slot column 102, one end of the plural first terminals 110, e.g. but not limited to the right end, are respectively disposed in front of the plural slot columns 102, the lateral sides thereof are respectively and downwardly bent then further bent towards right or left thereby forming a surface, wherein the two first terminals 110 at the right side are bent towards right, the two first terminals 110 at the left side are bent towards left, thereby respectively forming a first solder end 111. Wherein, the quantity of the plural first terminals 110 is the same as that of the plural slot columns 102, and the quantity is e.g. but not limited to four.

One end of the plural second terminals 120, e.g. but not limited to the right end, are respectively provided in the plural open slots 101 and exposed outside the open slots 101, the other ends, e.g. but not limited to the left end, are respectively and downwardly bent then horizontally extended, thereby forming a second solder end 121. The front of the connector main body 100 is downwardly extended for forming a stop part 130 having a first lead angle 131, e.g. but not limited to 30 degree. Wherein, the stop part 130 is served to stop and position the substrate 200, such that plural first contact pads 210 and plural second contact pads 220 are able to be aligned with the first solder ends 111 of the plural first terminals 110 and the second solder ends 121 of the plural second terminals 120. The quantity of the plural second terminals 120 is the same as that of the plural open slots 101, and the quantity is e.g. but not limited to five.

In addition, one end of each second terminal 120 is exposed outside the open slot 101 then further upwardly bent then downwardly bent.

The substrate 200 has the plural first contact pads 210 and the plural second contact pads 220 respectively exposed outside the substrate 200, wherein the plural first contact pads 210 are disposed at the front portion of the substrate 200 and at the locations corresponding to the first solder ends 111 thereby allowing the plural first terminals 110 to be coupled with, the plural second contact pads 220 are disposed at the rear portion of the substrate 200 and at the locations corresponding to the second solder ends 121 thereby allowing the plural second terminals 120 to be coupled with, so as to form a USB connector.

In addition, the front of each first terminal 110 is further formed with a second lead angle 140, e.g. but not limited to 30 degree.

Moreover, the substrate 200 is, e.g. but not limited to, a Chip-On-Board (COB) substrate or a printed circuit board substrate; in this embodiment, the COB substrate is adopted for illustration and not served as a limitation. The COB technology has properties of thin thickness, compact wiring and small area, so it is widely used in the package of LCD driving chips or NAND flash memories.

The quantity of the plural first contact pads 210 is e.g. but not limited to four, thereby forming a USB2.0 connector, wherein the plural first contact pads 210 are able to respectively transmit $V_{BUS}$, D−, D+ and GND signals of USB2.0 specification. The quantity of the plural second contact pads 220 is e.g. but not limited to five, wherein the plural second contact pads 220 are able to respectively transmit StdA_SSRX−, StdA_SSRX+, GND_DRAIN, StdA_SSTX− and StdA_SSTX+ signals of USB3.0 specification.

According to the USB connector provided by the present invention, the substrate 200 further includes a USB controller 230 and at least a flash memory 240 respectively coupled to the plural first contact pads 210 and the plural second contact pads 220. The USB controller 230 and the flash memory 240 are installed on the substrate 200 with the Chip-On-Board (COB) means, wherein the Chip-On-Board technique is a conventional art therefore no further illustration is provided.

Referring to FIG. 3 and FIG. 4, when being manufactured, firstly the plural first terminals 110 are disposed in front of the plural second terminals 120, then integrally formed with the connector main body 100 for assembling as one piece; then the connector main body 100 is disposed on the substrate 200 and one end of the substrate 200 abuts against the stop part 130 for allowing the first solder ends 111 of the plural first terminals 110 and the second solder ends 121 of the plural second terminals 120 to be respectively aligned with the plural first contact pads 210 and the plural second contact pads 220, then respectively soldered on the plural first contact pads 210 and the plural second contact pads 220 with a Surface Mount Technology (SMT), thereby forming the USB connector of the present invention. According to the USB connector provided by the present invention, the four first terminals 110 can form a USB2.0 connector, the five second terminals 120 of the USB connector can form a USB3.0 connector, thereby respectively allowing a USB2.0 plug or a USB3.0 plug to be inserted. As such, the USB connector provided by the present invention has advantages of the substrate being prevented from squeezing the front edges of terminals of a USB plug, having thinner thickness, lower production cost and not limiting to be applied in certain models when being used.

As shown in FIG. 5, when the USB connector of the present invention is inserted with a USB plug 300, through being guided by the first lead angle 131 and the second lead angle 140, the front edge of the substrate 200 is enabled to be in forward contact with a terminal 310 of the USB plug 300 without squeezing the front edge of the terminal 310 of the USB plug 300. As such, the USB connector of the present invention is capable of being in contact with the USB plug 300 with a smoother manner, thereby improving the disadvantages of the conventional USB connector.

Figure 6:
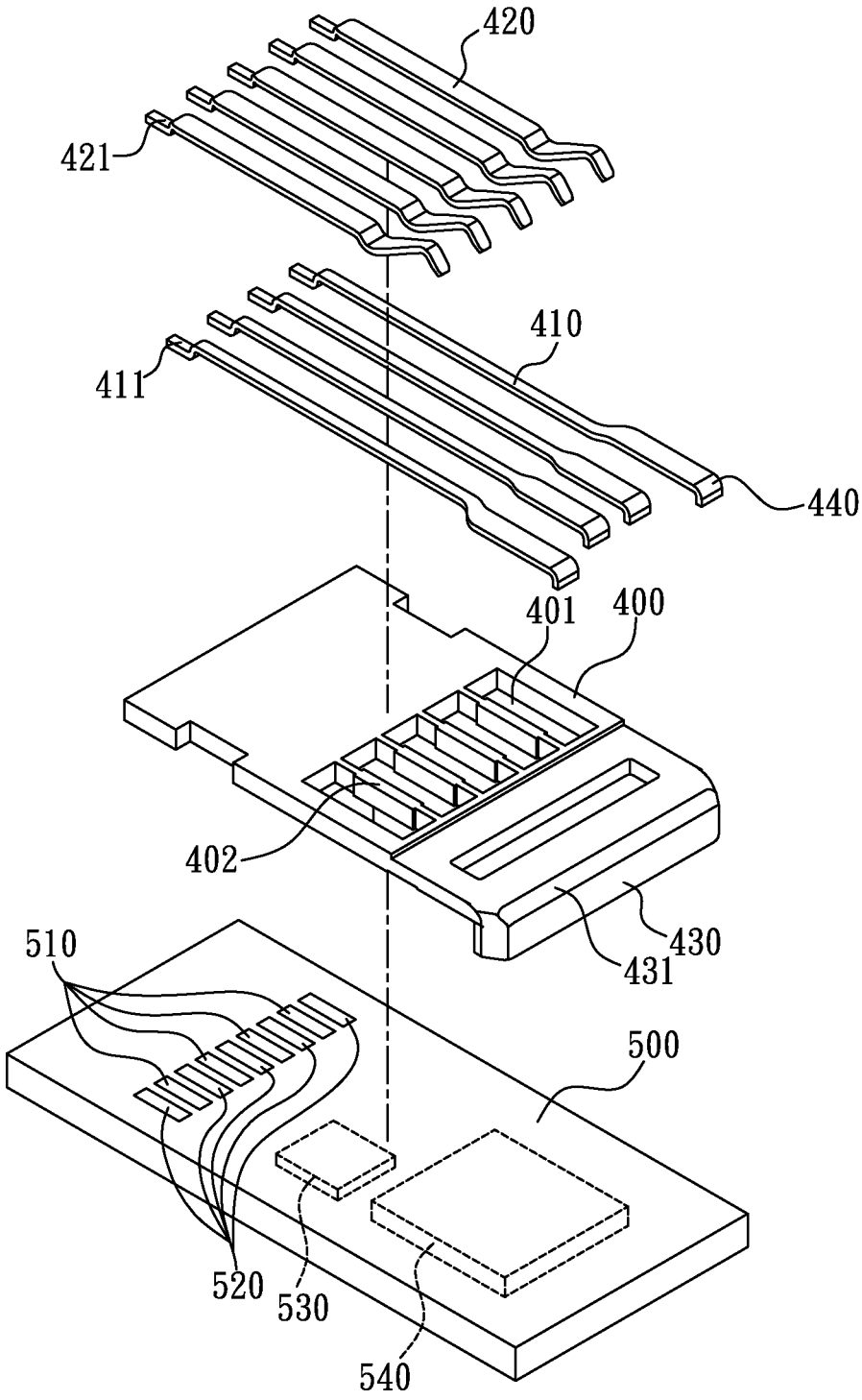
FIG. 6 is a schematic exploded view showing the USB connector according to another preferred embodiment of the present invention.
Figure 7:
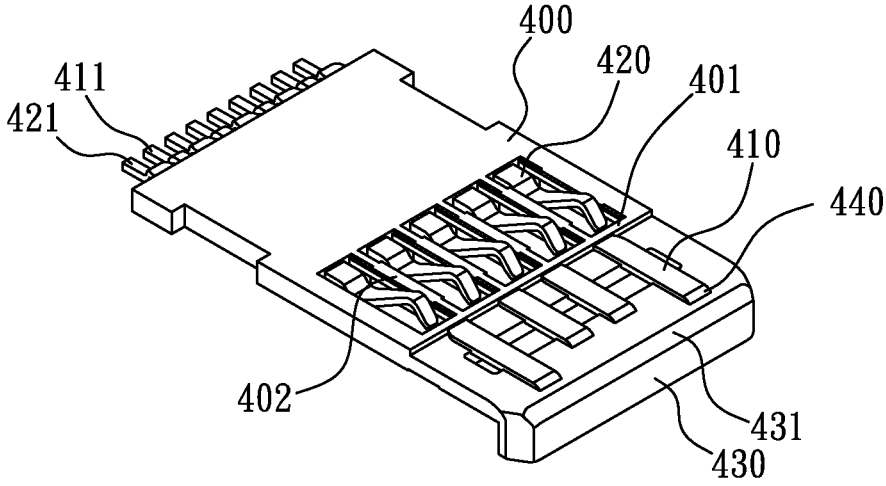
FIG. 7 is a schematic view showing the assembly of the connector main body according to another preferred embodiment of the present invention.
Figure 8:
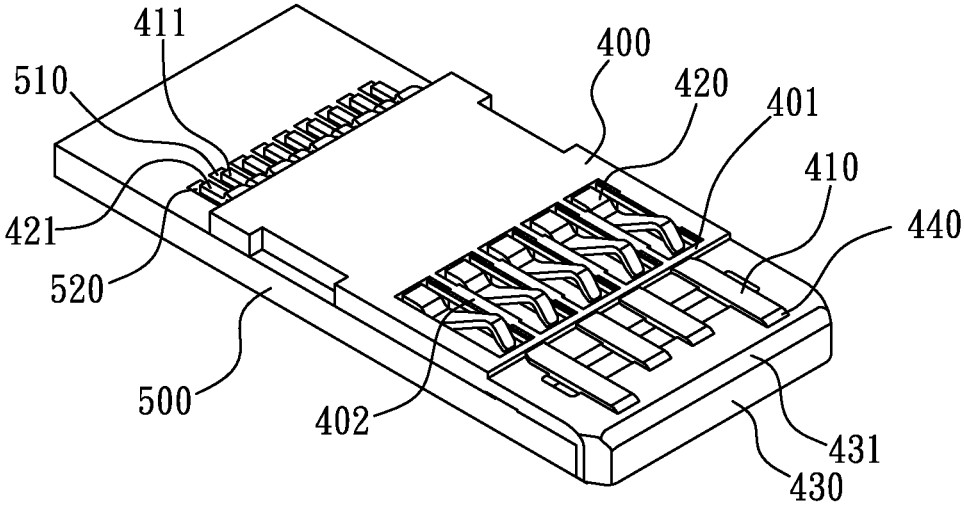
FIG. 8 is a schematic view showing the assembly of the USB connector according to another preferred embodiment of the present invention.

Referring from FIG. 6 to FIG. 8, wherein FIG. 6 is a schematic exploded view showing the USB connector according to another preferred embodiment of the present invention; FIG. 7 is a schematic view showing the assembly of the connector main body according to another preferred embodiment of the present invention; and FIG. 8 is a schematic view showing the assembly of the USB connector according to another preferred embodiment of the present invention.

As shown in figures, the USB connector provided by the present invention comprises a connector main body 400 and a substrate 500.

The connector main body 400 is made of an insulation material, e.g. but not limited to plastic, and is formed with plural open slots 401, plural first terminals 410 and plural second terminals 420, wherein every two open slots 401 are spaced by a slot column 402, one end of the plural first terminals 410, e.g. but not limited to the right end, are respectively disposed below the plural slot columns 402, exposed outside the plural slot columns 402 then forwardly extended, the other ends, e.g. but not limited to the left end, are respectively and downwardly bent then horizontally extended, thereby forming a first solder end 411. Wherein, the quantity of the plural first terminals 410 is the same as that of the plural slot columns 402, and the quantity is e.g. but not limited to four. In addition, the front of the connector main body 400 is downwardly extended for forming a stop part 430 having a first lead angle 431, wherein the stop part 430 is served to stop and position the substrate 500, the first lead angle 431 is e.g. but not limited to 30 degree.

One end of the plural second terminals 420, e.g. but not limited to the right end, are respectively provided in the plural open slots 401 and exposed outside the open slots 401, the other ends, e.g. but not limited to the left end, are respectively and downwardly bent then horizontally extended, thereby forming a second solder end 421. Wherein, the quantity of the plural second terminals 420 is the same as that of the plural open slots 401, and the quantity is e.g. but not limited to five.

In addition, one end of each second terminal 420 is exposed outside the open slot 401 then further upwardly bent then downwardly bent.

The substrate 500 has plural first contact pads 510 and plural second contact pads 520 respectively exposed outside the substrate 500, and the plural first contact pads 510 and the plural second contact pads 520 are, for example, staggeringly arranged. The plural first contact pads 510 and the plural second contact pads 520 are respectively served to allow the first solder ends 411 of the plural first terminals 410 and the second solder ends 421 of the plural second terminals 420 to be soldered thereon.

In addition, the front of each first terminal 410 is further formed with a second lead angle 440, e.g. but not limited to 30 degree. The function of the first lead angle 431 and the second lead angle 440 is the same as that of the first lead angle 131 and the second lead angle 140, therefore no further illustration is provided.

Moreover, the substrate 500 is, e.g. but not limited to, a Chip-On-Board (COB) substrate or a printed circuit board substrate; in this embodiment, the COB substrate is adopted for illustration and not served as a limitation. The COB technology has properties of thin thickness, compact wiring and small area, so it is widely used in the package of LCD driving chips or NAND flash memories.

The quantity of the plural first contact pads 510 is e.g. but not limited to four, thereby forming a USB2.0 connector, wherein the plural first contact pads 510 are able to respectively transmit $V_{BUS}$, D−, D+ and GND signals of USB2.0 specification.

The plural second contact pads 520 are, for example, staggeringly arranged with the plural first contact pads 510, the quantity thereof is e.g. but not limited to five, wherein the plural second contact pads 520 are able to respectively transmit StdA_SSRX−, StdA_SSRX+, GND_DRAIN, StdA_SSTX− and StdA_SSTX+ signals of USB3.0 specification.

According to the USB connector provided by the present invention, the substrate 500 further includes a USB controller 530 and at least a flash memory 540 respectively coupled to the plural first contact pads 510 and the plural second contact pads 520. The USB controller 530 and the flash memory 540 are installed on the substrate 500 with the Chip-On-Board (COB) means, wherein the Chip-On-Board technique is a conventional art therefore no further illustration is provided.

Referring to FIG. 7 and FIG. 8, when being manufactured, firstly the plural first terminals 410 and the plural second terminals 420 are staggeringly arranged, then integrally formed with the connector main body 400 for assembling as one piece; then the connector main body 400 is disposed on the substrate 500 and one end thereof abuts against the stop part 430 for allowing the first solder ends 411 of the plural first terminals 410 and the second solder ends 421 of the plural second terminals 420 to be respectively aligned with the plural first contact pads 510 and the plural second contact pads 520, then respectively soldered on the plural first contact pads 510 and the plural second contact pads 520 with a Surface Mount Technology (SMT), thereby forming the USB connector of the present invention. According to the USB connector provided by the present invention, the four first terminals 410 can form a USB2.0 connector, the five second terminals 420 of the USB connector can form a USB3.0 connector, thereby respectively allowing a USB2.0 plug or a USB3.0 plug to be inserted. As such, the USB connector provided by the present invention has advantages of the substrate being prevented from squeezing the front edges of terminals of a USB plug, having thinner thickness, lower production cost and not limiting to be applied in certain models when being used.

Figure 9:
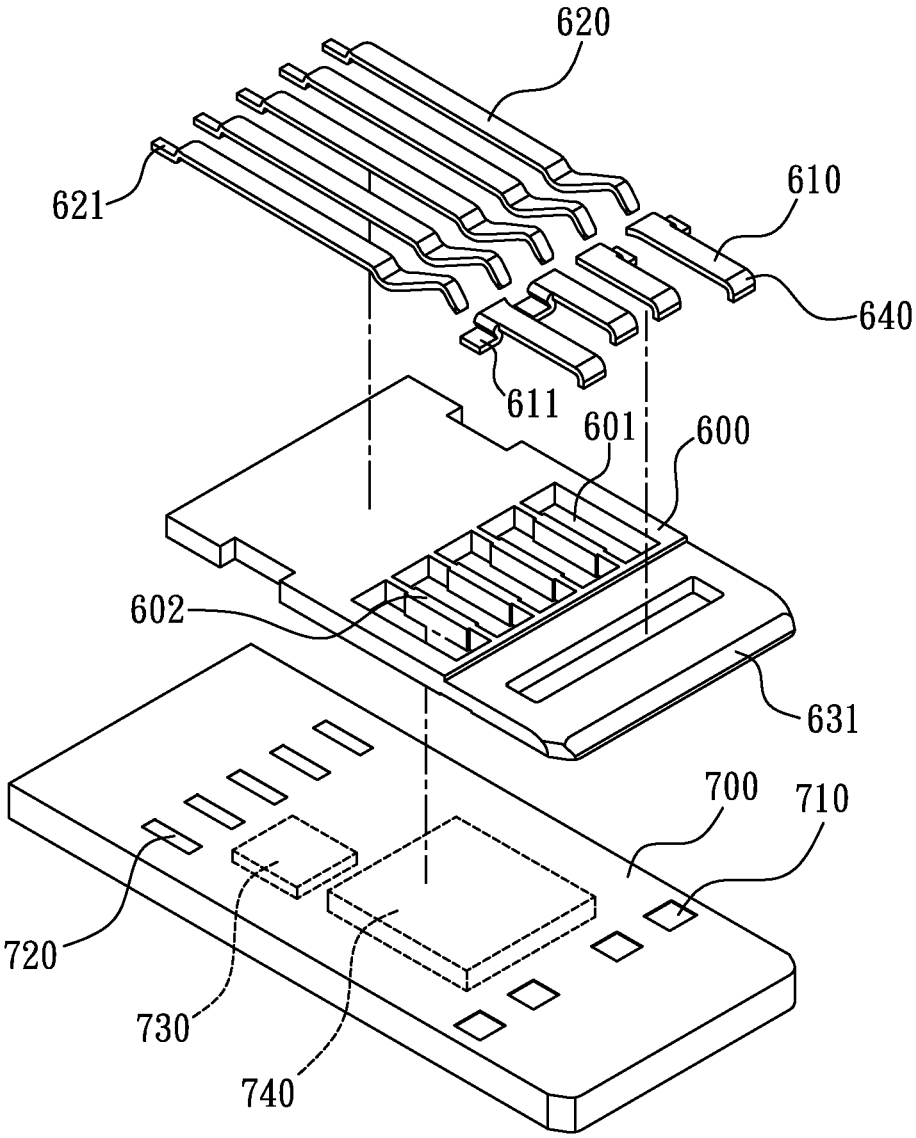
FIG. 9 is a schematic exploded view showing the USB connector according to one another preferred embodiment of the present invention.
Figure 10:
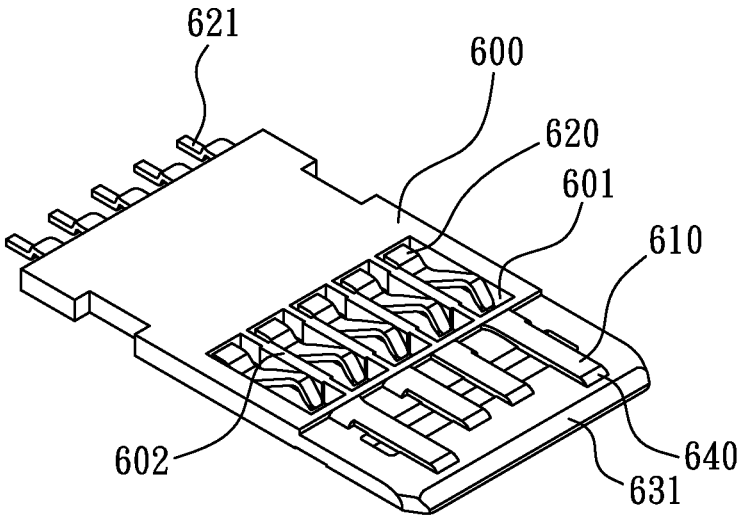
FIG. 10 is a schematic view showing the assembly of the connector main body according to one another preferred embodiment of the present invention.
Figure 11:
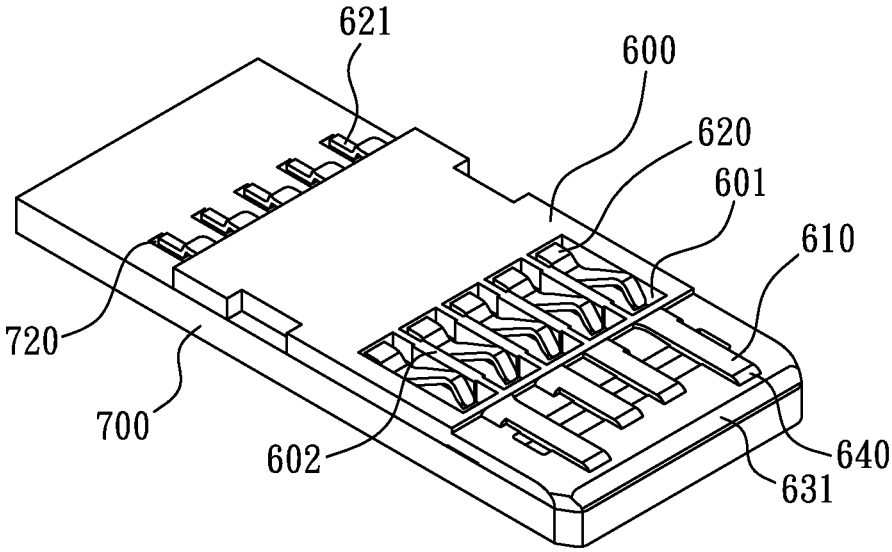
FIG. 11 is a schematic view showing the assembly of the USB connector according to one another preferred embodiment of the present invention.

Referring from FIG. 9 to FIG. 11, wherein FIG. 9 is a schematic exploded view showing the USB connector according to one another preferred embodiment of the present invention; FIG. 10 is a schematic view showing the assembly of the connector main body according to one another preferred embodiment of the present invention; and FIG. 11 is a schematic view showing the assembly of the USB connector according to one another preferred embodiment of the present invention.

As shown in figures, the USB connector provided by the present invention comprises a connector main body 600 and a substrate 700.

The connector main body 600 is made of an insulation material, e.g. but not limited to plastic, and is formed with plural open slots 601, plural first terminals 610 and plural second terminals 620, wherein every two open slots 601 are spaced by a slot column 602, one end of the plural first terminals 610, e.g. but not limited to the right end, are respectively disposed in front of the plural slot columns 602, the lateral sides thereof are respectively and downwardly bent then further bent towards right or left thereby forming a surface, wherein the two first terminals 610 at the right side are bent towards right, the two first terminals 610 at the left side are bent towards left thereby respectively forming a first solder end 611. Wherein, the quantity of the plural first terminals 610 is the same as that of the plural slot columns 602, and the quantity is e.g. but not limited to four.

One end of the plural second terminals 620, e.g. but not limited to the right end, are respectively provided in the plural open slots 601 and exposed outside the open slots 601, the other ends, e.g. but not limited to the left end, are respectively and downwardly bent then horizontally extended, thereby forming a second solder end 621. The front of the connector main body 600 is formed with a first lead angle 631, e.g. but not limited to 30 degree. Wherein, the quantity of the plural second terminals 620 is the same as that of the plural open slots 601, and the quantity is e.g. but not limited to five.

In addition, one end of each second terminal 620 is exposed outside the open slot 601 then further upwardly bent then downwardly bent.

The substrate 700 has plural first contact pads 710 and plural second contact pads 720 respectively exposed outside the substrate 700, wherein the plural first contact pads 710 are disposed at the front portion of the substrate 700 and at the locations corresponding to the first solder ends 611 thereby allowing the plural first terminals 610 to be coupled with, the plural second contact pads 720 are disposed at the rear portion of the substrate 700 and at the locations corresponding to the second solder ends 621 thereby allowing the plural second terminals 620 to be coupled with, so as to form a USB connector.

Moreover, the substrate 700 is, e.g. but not limited to, a Chip-On-Board (COB) substrate or a printed circuit board substrate; in this embodiment, the COB substrate is adopted for illustration and not served as a limitation. The COB technology has properties of thin thickness, compact wiring and small area, so it is widely used in the package of LCD driving chips or NAND flash memories.

The quantity of the plural first contact pads 710 is e.g. but not limited to four, thereby forming a USB2.0 connector, wherein the plural first contact pads 710 are able to respectively transmit $V_{BUS}$, D−, D+ and GND signals of USB2.0 specification.

The quantity of the plural second contact pads 720 is e.g. but not limited to five, wherein the plural second contact pads 720 are able to respectively transmit StdA_SSRX−, StdA_SSRX+, GND_DRAIN, StdA_SSTX− and StdA_SSTX+ signals of USB3.0 specification.

In addition, the front of each first terminal 610 is further formed with a second lead angle 640, e.g. but not limited to 30 degree. The function of the first lead angle 631 and the second lead angle 640 is the same as that of the first lead angle 131 and the second lead angle 140, therefore no further illustration is provided.

According to the USB connector provided by the present invention, the substrate 700 further includes a USB controller 730 and at least a flash memory 740 respectively coupled to the plural first contact pads 710 and the plural second contact pads 720. The USB controller 730 and the flash memory 740 are installed on the substrate 700 with the Chip-On-Board (COB) means, wherein the Chip-On-Board technique is a conventional art therefore no further illustration is provided.

Referring to FIG. 10 and FIG. 11, when being manufactured, firstly the plural first terminals 610 are disposed in front of the plural second terminals 620, then integrally formed with the connector main body 600 for assembling as one piece; then the connector main body 600 is disposed on the substrate 700, such that the front edge of the substrate 700 is aligned with the front edge of the connector main body 600 thereby allowing the first solder ends 611 of the plural first terminals 610 and the second solder ends 621 of the plural second terminals 620 to be respectively aligned with the plural first contact pads 710 and the plural second contact pads 720, then respectively soldered on the plural first contact pads 710 and the plural second contact pads 720 with a Surface Mount Technology (SMT), thereby forming the USB connector of the present invention. According to the USB connector provided by the present invention, the four first terminals 610 can form a USB2.0 connector, the five second terminals 620 of the USB connector can form a USB3.0 connector, thereby respectively allowing a USB2.0 plug or a USB3.0 plug to be inserted. As such, the USB connector provided by the present invention has advantages of the substrate being prevented from squeezing the front edges of terminals of a USB plug, having thinner thickness, lower production cost and not limiting to be applied in certain models when being used.

Figure 12:
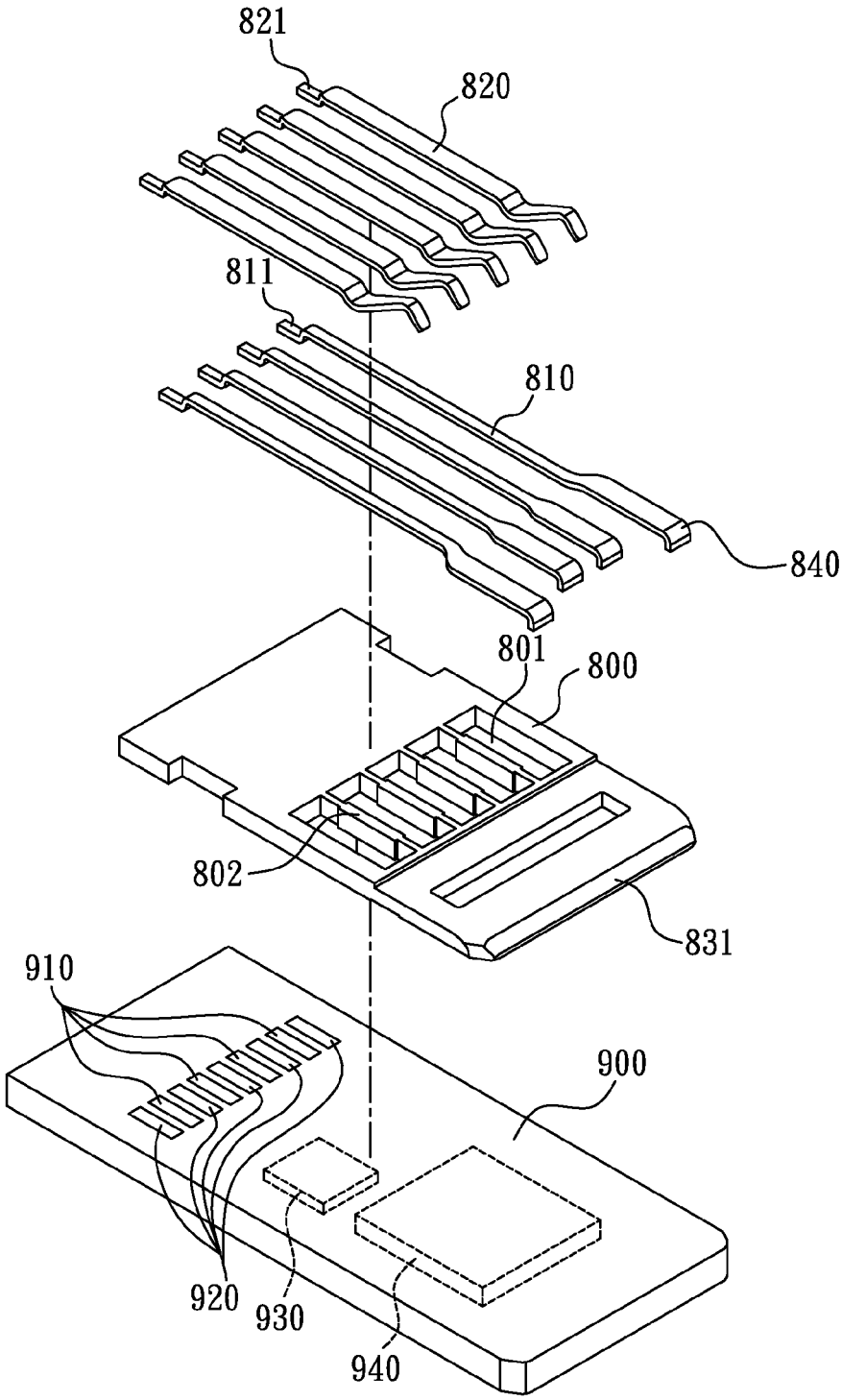
FIG. 12 is a schematic exploded view showing the USB connector according to still one another preferred embodiment of the present invention.
Figure 13:
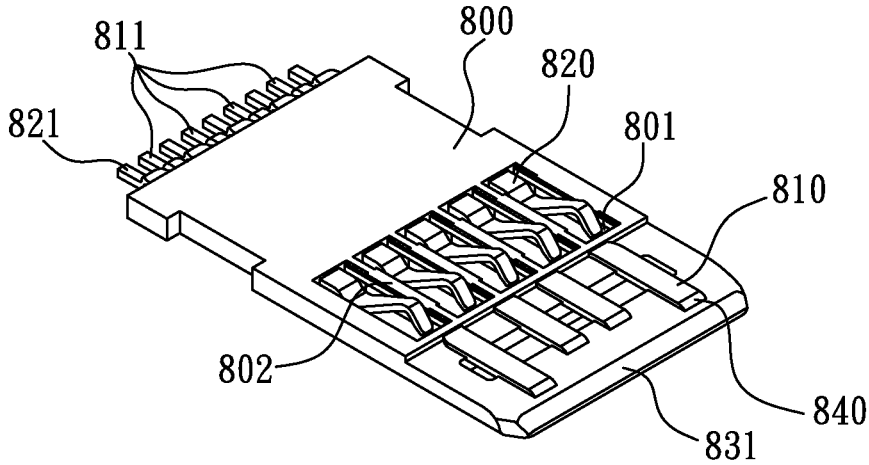
FIG. 13 is a schematic view showing the assembly of the connector main body according to still one another preferred embodiment of the present invention.
Figure 14:
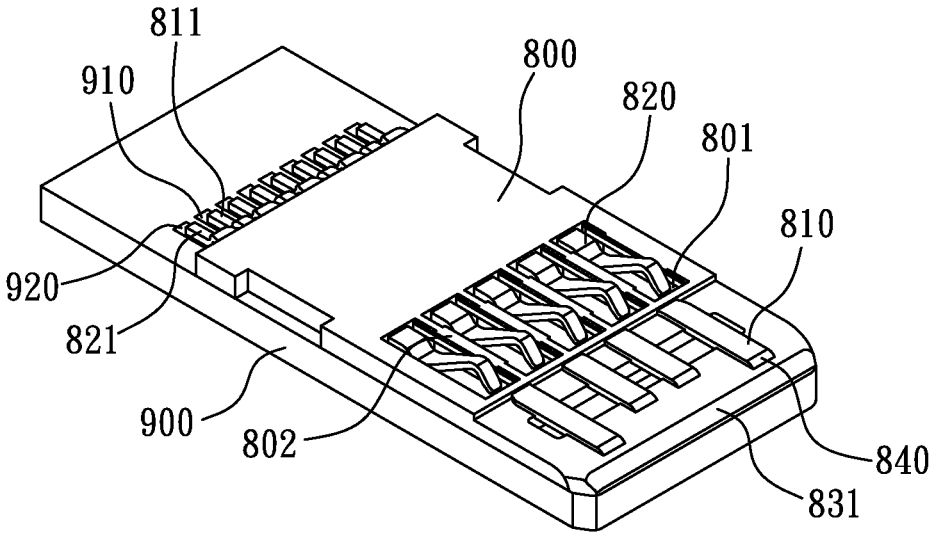
FIG. 14 is a schematic view showing the assembly of the USB connector according to still one another preferred embodiment of the present invention.

Referring from FIG. 12 to FIG. 14, wherein FIG. 12 is a schematic exploded view showing the USB connector according to still one another preferred embodiment of the present invention; FIG. 13 is a schematic view showing the assembly of the connector main body according to still one another preferred embodiment of the present invention; and FIG. 14 is a schematic view showing the assembly of the USB connector according to still one another preferred embodiment of the present invention.

As shown in figures, the USB connector provided by the present invention comprises a connector main body 800 and a substrate 900.

The connector main body 800 is made of an insulation material, e.g. but not limited to plastic, and is formed with plural open slots 801, plural first terminals 810 and plural second terminals 820, wherein every two open slots 801 are spaced by a slot column 802, one end of the plural first terminals 810, e.g. but not limited to the right end, are respectively disposed below the plural slot columns 802, exposed outside the plural slot columns 802 then forwardly extended, the other ends, e.g. but not limited to the left end, are respectively and downwardly bent then horizontally extended, thereby forming a first solder end 811. Wherein, the quantity of the plural first terminals 810 is the same as that of the plural slot columns 802, and the quantity is e.g. but not limited to four. Moreover, the front of the connector main body 800 is formed with a first lead angle 831, e.g. but not limited to 30 degree.

One end of the plural second terminals 820, e.g. but not limited to the right end, are respectively provided in the plural open slots 801 and exposed outside the open slots 801, the other ends, e.g. but not limited to the left end, are respectively and downwardly bent then horizontally extended, thereby forming a second solder end 821. Wherein, the quantity of the plural second terminals 820 is the same as that of the plural open slots 801, and the quantity is e.g. but not limited to five.

In addition, one end of each second terminal 820 is exposed outside the open slot 801 then further upwardly bent then downwardly bent.

The substrate 900 has plural first contact pads 910 and plural second contact pads 920 respectively exposed outside the substrate 900, and the plural first contact pads 910 and the plural second contact pads 920 are, for example, staggeringly arranged. The plural first contact pads 910 and the plural second contact pads 920 are respectively served to allow the first solder ends 811 of the plural first terminals 810 and the second solder ends 821 of the plural second terminals 820 to be soldered thereon.

Moreover, the substrate 900 is, e.g. but not limited to, a Chip-On-Board (COB) substrate or a printed circuit board substrate; in this embodiment, the COB substrate is adopted for illustration and not served as a limitation. The COB technology has properties of thin thickness, compact wiring and small area, so it is widely used in the package of LCD driving chips or NAND flash memories.

The quantity of the plural first contact pads 910 is e.g. but not limited to four, thereby forming a USB2.0 connector, wherein the plural first contact pads 910 are able to respectively transmit $V_{BUS}$, D−, D+ and GND signals of USB2.0 specification. The plural second contact pads 920 are, for example, staggeringly arranged with the plural first contact pads 910, the quantity thereof is e.g. but not limited to five, wherein the plural second contact pads 920 are able to respectively transmit StdA_SSRX−, StdA_SSRX+, GND_DRAIN, StdA_SSTX− and StdA_SSTX+ signals of USB3.0 specification.

In addition, the front of each first terminal 810 is further formed with a second lead angle 840, e.g. but not limited to 30 degree. The function of the first lead angle 831 and the second lead angle 840 is the same as that of the first lead angle 131 and the second lead angle 140, therefore no further illustration is provided.

According to the USB connector provided by the present invention, the substrate 900 further includes a USB controller 930 and at least a flash memory 940 respectively coupled to the plural first contact pads 910 and the plural second contact pads 920. The USB controller 930 and the flash memory 940 are installed on the substrate 900 with the Chip-On-Board (COB) means, wherein the Chip-On-Board technique is a conventional art therefore no further illustration is provided.

Referring to FIG. 13 and FIG. 14, when being manufactured, firstly the plural first terminals 810 and the plural second terminals 820 are staggeringly arranged, then integrally formed with the connector main body 800 for assembling as one piece; then the connector main body 800 is disposed on the substrate 900 for allowing the first solder ends 811 of the plural first terminals 810 and the second solder ends 821 of the plural second terminals 820 to be respectively aligned with the plural first contact pads 910 and the plural second contact pads 920, then respectively soldered on the plural first contact pads 910 and the plural second contact pads 920 with a Surface Mount Technology (SMT), thereby forming the USB connector of the present invention. According to the USB connector provided by the present invention, the four first terminals 810 can form a USB2.0 connector, the five second terminals 820 can form a USB3.0 connector, thereby respectively allowing a USB2.0 plug or a USB3.0 plug to be inserted. As such, the USB connector provided by the present invention has advantages of the substrate being prevented from squeezing the front edges of terminals of a USB plug, having thinner thickness, lower production cost and not limiting to be applied in certain models when being used.

As what is disclosed above, the USB connector of the present invention has following advantages: 1. having a USB2.0 connector and a USB3.0 connector having different transmission speed, for meeting the needs of USB connector having different transmission speed; 2. the front of the substrate being formed with a lead angle, so when being inserted with a USB plug, the lead angle allows the front edge of the substrate being in forward contact with terminals of the USB plug without squeezing the front edges of the terminals of the USB plug; 3. having plural first contact pads and plural second contact pads which can be arranged at the same side or oppositely arranged; and 4. Having thinner thickness, lower production cost and not limiting to be applied in certain models when being used. Therefore the USB connector provided by the present invention is novel compared to conventional USB connectors.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A USB connector, comprising:

a connector main body having plural open slots, plural first terminals and plural second terminals, every two open slots being spaced by a slot column, wherein one end of the plural first terminals being respectively disposed in front of the plural slot columns, the lateral sides thereof being respectively and downwardly bent then further bent towards right or left thereby forming a first solder end, one end of the plural second terminals being respectively provided in the plural open slots and exposed outside the open slots, the other ends being respectively and downwardly bent then horizontally extended thereby forming a second solder end, the front of the connector main body being downwardly extended thereby forming a stop part having a first lead angle; and a substrate having plural first contact pads and plural second contact pads, wherein the plural first contact pads being disposed at the front portion of the substrate and at the locations corresponding to the first solder ends thereby allowing the plural first terminals to be coupled with, the plural second contact pads being disposed at the rear portion of the substrate and at the locations corresponding to the second solder ends thereby allowing the plural second terminals to be coupled with, so as to form a USB connector.

2. The USB connector as claimed in claim 1, wherein said substrate is a Chip-On-Board (COB) substrate or a printed circuit board substrate.

3. The USB connector as claimed in claim 1, wherein the quantity of said plural first contact pads, the quantity of said first solder ends and the quantity of said first terminals are all four for forming a USB2.0 connector; the quantity of said plural second contact pads, the quantity of said second solder ends, the quantity of said plural open slots and the quantity of said second terminals are all five for forming a USB3.0 connector.

4. The USB connector as claimed in claim 1, wherein said substrate further includes a USB controller and at least a flash memory respectively coupled to said plural first contact pads and said plural second contact pads.

5. The USB connector as claimed in claim 1, wherein one end of each second terminal is exposed outside said open slot then further upwardly bent then downwardly bent, and the front of each first terminal is further formed with a second lead angle, and the first lead angle and the second lead angle are both 30 degree.

6. A USB connector, comprising:

a connector main body having plural open slots, plural first terminals and plural second terminals, wherein every two open slots being spaced by a slot column, one end of the plural first terminals being respectively disposed below the plural slot columns and exposed outside the plural slot columns then forwardly extended, the other ends being respectively and downwardly bent then horizontally extended thereby forming a first solder end, one end of the plural second terminals being respectively provided in the plural open slots and exposed outside the open slots, the other ends being respectively and downwardly bent then horizontally extended thereby forming a second solder end, the front of the connector main body being downwardly extended thereby forming a stop part having a first lead angle; and a substrate having plural first contact pads and plural second contact pads, and the plural first contact pads and the plural second contact pads being staggeringly arranged for being respectively coupled to the plural first terminals and the plural second terminals, thereby forming a USB connector.

7. The USB connector as claimed in claim 6, wherein said substrate is a Chip-On-Board (COB) substrate or a printed circuit board substrate.

8. The USB connector as claimed in claim 6, wherein the quantity of said plural first contact pads, the quantity of said first solder ends and the quantity of said first terminals are all four for forming a USB2.0 connector; the quantity of said plural second contact pads, the quantity of said second solder ends, the quantity of said plural open slots and the quantity of said second terminals are all five for forming a USB3.0 connector.

9. The USB connector as claimed in claim 6, wherein said substrate further includes a USB controller and at least a flash memory respectively coupled to said plural first contact pads and said plural second contact pads.

10. The USB connector as claimed in claim 6, wherein one end of each second terminal is exposed outside said open slot then further upwardly bent then downwardly bent, and the front of each first terminal is further formed with a second lead angle, and the first lead angle and the second lead angle are both 30 degree.

11. A USB connector, comprising:

a connector main body having plural open slots, plural first terminals and plural second terminals, every two open slots being spaced by a slot column, wherein one end of the plural first terminals being respectively disposed in front of the plural slot columns, the lateral sides thereof being respectively and downwardly bent then further bent towards right or left thereby forming a first solder end, one end of the plural second terminals being respectively provided in the plural open slots and exposed outside the open slots, the other ends being respectively and downwardly bent then horizontally extended thereby forming a second solder end, the front of the connector main body being formed with a first lead angle; and a substrate having plural first contact pads and plural second contact pads, wherein the plural first contact pads being disposed at the front portion of the substrate and at the locations corresponding to the first solder ends thereby allowing the plural first terminals to be coupled with, the plural second contact pads being disposed at the rear portion of the substrate and at the locations corresponding to the second solder ends thereby allowing the plural second terminals to be coupled with, so as to form a USB connector.

12. The USB connector as claimed in claim 11, wherein said substrate is a Chip-On-Board (COB) substrate or a printed circuit board substrate.

13. The USB connector as claimed in claim 11, wherein the quantity of said plural first contact pads, the quantity of said first solder ends and the quantity of said first terminals are all four for forming a USB2.0 connector; the quantity of said plural second contact pads, the quantity of said second solder ends, the quantity of said plural open slots and the quantity of said second terminals are all five for forming a USB3.0 connector.

14. The USB connector as claimed in claim 11, wherein said substrate further includes a USB controller and at least a flash memory respectively coupled to said plural first contact pads and said plural second contact pads.

15. The USB connector as claimed in claim 11, wherein one end of each second terminal is exposed outside said open slot then further upwardly bent then downwardly bent, and the front of each first terminal is further formed with a second lead angle, and the first lead angle and the second lead angle are both 30 degree.

16. A USB connector, comprising:

a connector main body having plural open slots, plural first terminals and plural second terminals, wherein every two open slots being spaced by a slot column, one end of the plural first terminals being respectively disposed below the plural slot columns and exposed outside the plural slot columns then forwardly extended, the other ends being respectively and downwardly bent then horizontally extended thereby forming a first solder end, one end of the plural second terminals being respectively provided in the plural open slots and exposed outside the open slots, the other ends being respectively and downwardly bent then horizontally extended thereby forming a second solder end, the front of the connector main body being formed with a first lead angle; and a substrate having plural first contact pads and plural second contact pads, and the plural first contact pads and the plural second contact pads being staggeringly arranged for being respectively coupled to the plural first terminals and the plural second terminals, thereby forming a USB connector.

17. The USB connector as claimed in claim 16, wherein said substrate is a Chip-On-Board (COB) substrate or a printed circuit board substrate.

18. The USB connector as claimed in claim 16, wherein the quantity of said plural first contact pads, the quantity of said first solder ends and the quantity of said first terminals are all four for forming a USB2.0 connector; the quantity of said plural second contact pads, the quantity of said second solder ends, the quantity of said plural open slots and the quantity of said second terminals are all five for forming a USB3.0 connector.

19. The USB connector as claimed in claim 16, wherein said substrate further includes a USB controller and at least a flash memory respectively coupled to said plural first contact pads and said plural second contact pads.

20. The USB connector as claimed in claim 16, wherein one end of each second terminal is exposed outside said open slot then further upwardly bent then downwardly bent, and the front of each first terminal is further formed with a second lead angle, and the first lead angle and the second lead angle are both 30 degree.

* * * * *